US006633210B1

(12) United States Patent
Fischer et al.

(10) Patent No.: US 6,633,210 B1
(45) Date of Patent: Oct. 14, 2003

(54) SWITCH LEVER CAPTIVATION DEVICE

(75) Inventors: Kenneth Martin Fischer, Finelyville, PA (US); Robert Michael Pomaybo, Beaver, PA (US); Joseph Bell Humbert, Monaca, PA (US)

(73) Assignee: Eaton Corporation, Cleveland, OH (US)

( * ) Notice: Subject to any disclaimer, the term of this patent is extended or adjusted under 35 U.S.C. 154(b) by 455 days.

(21) Appl. No.: 09/663,058

(22) Filed: Sep. 15, 2000

(51) Int. Cl.[7] ..... H01H 75/00; H01H 73/12
(52) U.S. Cl. ..... 335/6; 335/13; 335/17
(58) Field of Search ..... 335/6–10, 11, 335/13, 17, 21, 36, 38

(56) References Cited

U.S. PATENT DOCUMENTS 5,552,755 A 9/1996 Fello et al.
6,227,908 B1 * 5/2001 Aumeier et al. ..... 439/607
6,471,545 B1 * 10/2002 Hosler, Sr. ..... 439/585

* cited by examiner

*Primary Examiner*—Ramon M. Barrera
(74) *Attorney, Agent, or Firm*—Martin J. Moran

(57) ABSTRACT

A securing member for use in a switch assembly of a circuit breaker includes a support post and a fastener. The securing member assists in mounting an alarm switch onto a bracket of the switch assembly and further resists movement of the actuation levers of a pair of auxiliary switches from moving beyond a first given position and from potentially becoming caught in an operating mechanism that pivots a crossbar. The dual functionality of the securing member is cost effective and occupies only a minimal amount of additional space within the crowded confines of the circuit breaker.

14 Claims, 3 Drawing Sheets

SWITCH LEVER CAPTIVATION DEVICE

BACKGROUND OF THE INVENTION

1. Field of the Invention

The present invention relates generally to circuit breakers and, more particularly, to circuit breakers employing one or more alarm switches and/or auxiliary switches that are operated by the operating mechanism of the circuit breaker. Specifically, the invention relates to a securing member that resists movement of a switch actuation lever toward a crossbar of an operating mechanism to avoid the actuation lever from becoming entangled with the operating mechanism.

2. Description of the Related Art

As is understood in the relevant art, circuit breakers are used for numerous purposes in power distribution systems. Among such purposes is the interruption of current in a protected system during certain specified overcurrent and under-voltage conditions, as well as other conditions. In multi-pole circuit breakers, each pole includes a stationary contact and a movable contact, the movable contact being pivotable into and out of electrical engagement with the stationary contact.

The movable contacts typically are commonly operatively mounted on an operating mechanism that simultaneously moves all of the movable contacts out of electrical engagement with the stationary contacts in the event of a specified overcurrent or under-voltage condition or other condition. The operating mechanism typically includes a rotatable crossbar extending between the poles to which the movable contacts are operatively mounted. Rotation of the crossbar causes the movable contacts of all of the poles to be simultaneously pivoted into and out of electrical engagement with the stationary contacts as needed.

Inasmuch as the electrical disengagement of the movable contacts from the stationary contacts results in an interruption of current through the circuit breaker, it is known in the art to provide one or more switches that are mechanically operated by the crossbar or other components of the operating mechanism or other mechanisms and that are operatively connected with alarm bells, warning lights, and other devices that are calculated to inform a technician that the circuit breaker is in an interrupted or off condition. Such switches are components in a switch assembly that is mountable within the circuit breaker and often include an alarm switch that is operatively connected with the cradle or handle of the operating mechanism to detect a tripped state of the circuit breaker and one or more auxiliary switches that are operatively connected with the crossbar and indicate the open or closed state of the separable contacts. In such applications, the switches usually each include an actuation lever in the form of a tang of spring steel or other material that is connected at an attachment end thereof with the switch housing and that protrudes outwardly therefrom. The crossbar includes one or more eccentric camming surfaces which, upon rotation of the crossbar, depress the actuation levers of the switches. Depression of the actuation levers by the camming surfaces causes the actuation levers to each depress a plunger that actuates the electrical contacts within the switch that operate the alarm devices connected therewith.

While such switch assemblies have been effective for many of their intended purposes, such switch assemblies have not, however, been without limitation. It is known that the actuation levers of the auxiliary switches are slidably disposed against and are depressed by the camming surfaces of the crossbar during rotation of the crossbar. Moreover, it is known that rotation of the crossbar preferably occurs rapidly under the specified conditions to quickly separate the movable contacts. Some circuit breakers are configured such that during the aforementioned rotation, movement of the camming surfaces is in a direction from the free ends of the actuation levers toward the attachment ends thereof. In such configurations, it has occasionally been observed that during rapid movement of the camming surfaces, one or more of the actuation levers can undesirably be frictionally carried with the camming surfaces instead sliding thereon. Under such circumstances, the affected actuation levers are pulled from one side of the crossbar to an opposed side of the crossbar, in which case the actuation levers are pulled away from operative contact with the plungers. Such a condition renders the switches become inoperable despite the tripped condition of the circuit breaker. Such a situation is undesirable inasmuch as the alarm devices with which the switches are connected will not operate when the circuit breaker is in the interrupted or off condition, which can, in turn, prolong the time during which the interrupted condition of the circuit breaker goes undetected by a technician. Moreover, the available space within a circuit breaker is extremely limited, and thus any device that is intended to resist such misactuation of the actuation levers must be tailored to fit within such a confined space. It is thus desired to provide a device that is compact and that resists entanglement of the actuation levers of auxiliary switches with the operating mechanism of a circuit breaker.

SUMMARY OF THE INVENTION

In view of the foregoing, a securing member is provided for use in conjunction with a switch assembly of a circuit breaker. The securing member includes a fastener and a support post mounted on and extending outwardly from the fastener. The switch assembly includes a bracket, an alarm switch, and at least a first auxiliary switch, with the securing member being mounted on the bracket. The securing member both mounts the alarm switch on the bracket and underlies the actuation levers of the auxiliary switches to resist movement of the actuation levers beyond a given position, which thus resists the actuation levers from becoming entangled in the operating mechanism of the circuit breaker. The fastener includes a flange and an attachment structure, with the flange being disposed against one side of the bracket, and with the attachment structure extending through a mounting hole formed in the bracket. The attachment structure is configured to mount the alarm switch on the bracket. The support post extends outwardly from the side of the flange opposite the attachment structure in a direction generally away from the alarm switch.

An aspect of the present invention is to provide an improvement to a circuit breaker of the type including an operating mechanism and a switch assembly, the switch assembly including a bracket, a first switch, and a second switch, the second switch including a housing and an actuation lever, the actuation lever extending at least partially alongside and being movable with respect to the housing, the first switch being mounted on the bracket with a fastener, in which the general nature of the improvement can be stated as including a support post mounted on the fastener, the support post being disposed adjacent the actuation lever and being structured to resist movement of the actuation lever farther away from the housing than a given position.

Another objective of the present invention is to provide a securing member for mounting a first switch to a bracket, the bracket being formed with at least a first mounting hole and carrying a second switch, the general nature of which can be stated as including a fastener structured to be at least partially received in the at least first mounting hole and a support post mounted on and extending outwardly from the fastener, the support post being structured to be disposed adjacent the second switch.

Still another aspect of the present invention is to provide a method of resisting movement of a first actuation lever of a first switch farther away from a first housing of the first switch than a first given position, the general nature of which can be stated as including the steps of mounting a second switch to a bracket with a fastener, providing a support post extending from the fastener, the support post being disposed alongside the first actuation lever, and abutting the first actuation lever against the support post when the first actuation lever is in the first given position.

BRIEF DESCRIPTION OF THE DRAWINGS

Similar numerals refer to similar parts throughout the specification.

DESCRIPTION OF THE PREFERRED EMBODIMENT

Figure 1:
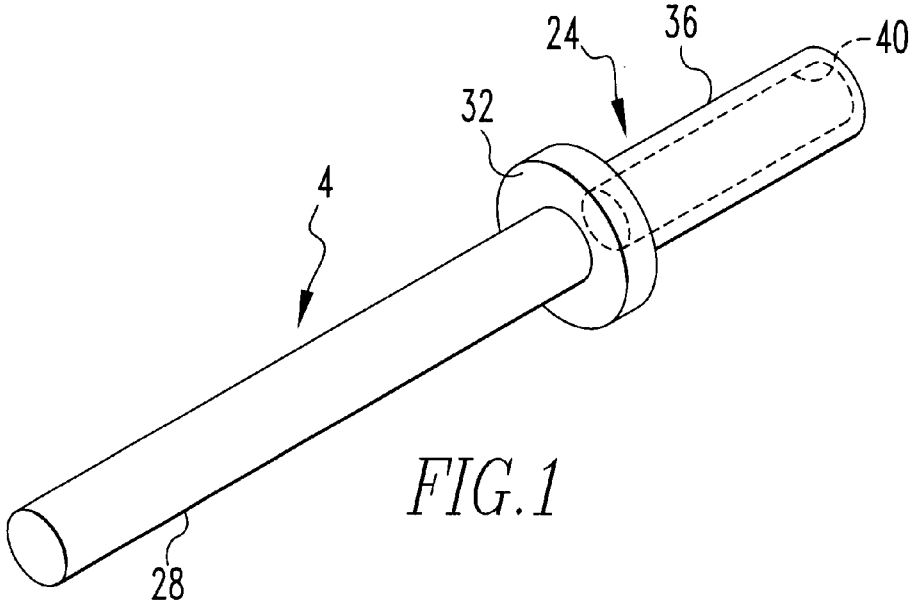
FIG. 1 is an isometric view of a securing member in accordance with the present invention.

A securing member 4 in accordance with the present invention is indicated generally in FIGS. 1–4. The securing member 4 is a component in a switch assembly 8 that is mounted within a circuit breaker 12. As is understood in the relevant art, the circuit breaker 12 includes an operating mechanism 16 that includes a crossbar 20, the crossbar 20 being rotatable during specified overcurrent and undervoltage conditions, as well as during other conditions such as routine opening and closing of the circuit protected by the circuit breaker 12.

Figure 2:
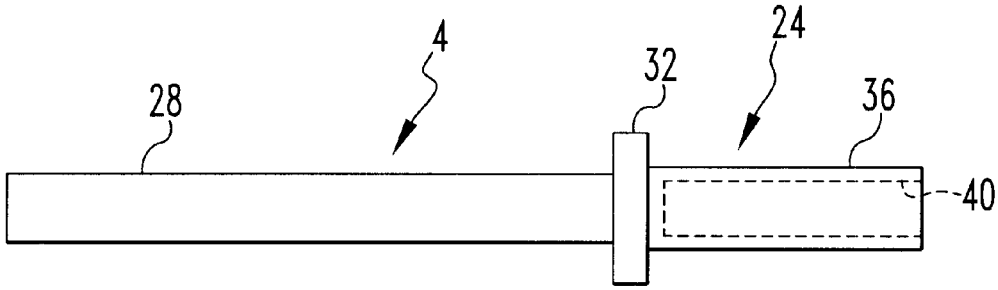
FIG. 2 is a front elevational view of the securing member.

As is best depicted in FIGS. 1 and 2, the securing member 4 includes a fastener 24 that is connected with a support post 28. The fastener 24 includes a flange 32 and an attachment structure 36 that is formed with an opening 40.

The support post 28 is a substantially cylindrical member having an arcuate outer surface. The flange 32 is annular member interposed between the support post 28 and the attachment structure 36. The flange 32 forms an annular shoulder, the importance of which will be set forth more fully below. The attachment structure 36 is a substantially cylindrical member, and the opening 40 formed therein is substantially cylindrical and is coaxially aligned with the attachment structure.

The support post 28, the flange 32, and the attachment structure 36 are all axially aligned with one another. While the securing member 4 is preferably an intregally formed one-piece member manufactured out of a single piece of material, it is understood that the securing member 4 may be a conjoined multi-part member, depending upon the specific needs of the particular application, without departing from the spirit of the present invention.

The switch assembly 8 may be of numerous configurations, and in the embodiment depicted herein includes a bracket 44, an alarm switch 48, a first auxiliary switch 52, and a second auxiliary switch 54. The bracket 44 is an approximately T-shaped member having a substantially planar plate 42 and a substantially planar leg 43, the alarm switch 48 and the first and second auxiliary switches 52 and 54 being mounted on the plate 42, with the leg 43 being mounted on structures within the circuit breaker 12. The plate 42 includes a first side 46 and a second side 50 opposite one another.

The first auxiliary switch 52 is preferably a conventional microswitch that includes a first housing 56 and a first actuation lever 58. The first housing 56 is an approximately rectangular member including a set of switch contacts that are operable by a first plunger mounted on the first housing 56. The first actuation lever 58 extends outwardly from the lower surface of the first housing 56 and extends substantially parallel with the lower surface of the first housing 56. The first actuation lever 58 includes a looped free end that is configured to operatively engage the crossbar 20 under appropriate circumstances.

The second auxiliary switch 54 is substantially similar to the first auxiliary switch 52 and includes a second housing 60 and a second actuation lever 62. The second housing 60 includes a set of switch contacts that are operable by a second plunger 61 (FIG. 4) mounted on the second housing 60. The second actuation lever 62 extends outwardly from the lower surface of the second housing 60 and extends substantially parallel therewith and terminates at a looped end that can operatively engage the crossbar 20 under appropriate circumstances.

The first and second auxiliary switches 52 and 54 are each formed with a pair of holes whereby a pair of auxiliary switch plugs 64 and a pair of auxiliary switch pins 68 extend through the holes and mount the first and second auxiliary switches 52 and 54 onto the first side 46 of the plate 42. It is understood, however, that alternate mounting structures may be employed for mounting the first and second auxiliary switches 52 and 54 onto the bracket 44 without departing from the spirit of the present invention.

The alarm switch 48 is mounted on the second side 50 of the plate 42, as will be set forth more fully below. The alarm switch 48 includes an alarm switch housing 72 and an alarm switch actuation lever 74 protruding from and extending at least partially parallel with the alarm switch housing 72. The alarm switch housing 72 includes a set of switch contacts that are operated upon depression of a plunger mounted on the alarm switch housing 72 by the alarm switch actuation lever 74. The alarm switch actuation lever 74 is itself depressed by rotation of a toggle bar 66 in conjunction with movement of a cradle of the operating mechanism 16 from a latched condition to an unlatched condition.

The toggle bar 66 is pivotably mounted on the second side 50 and includes a toggle body 76 and a tapered nose 70, with the tapered nose 70 extending from the toggle body 76. The tapered nose 70 is operatably engaged with the cradle of the operating mechanism 16. Movement of the operating mechanism 16 from the latched condition to the unlatched condition pivots the tapered nose 70 therewith and thus causes the toggle body 76 to operatively engage the alarm switch actuation lever 74 and operate the switch contacts operated by the plunger mounted on the alarm switch housing 72. When the operating mechanism is in the latched condition, a spring 80 biases the toggle bar 66 to a position away from the alarm switch actuation lever 74 such that the contacts of the alarm switch 48, if normally open, remain open. As is understood in the relevant art, the alarm switch 48 is typically electrically connected with an alarm bell, warning light, or other apparatus that is triggered whenever the operating mechanism 16 is in the unlatched condition.

Figure 3:
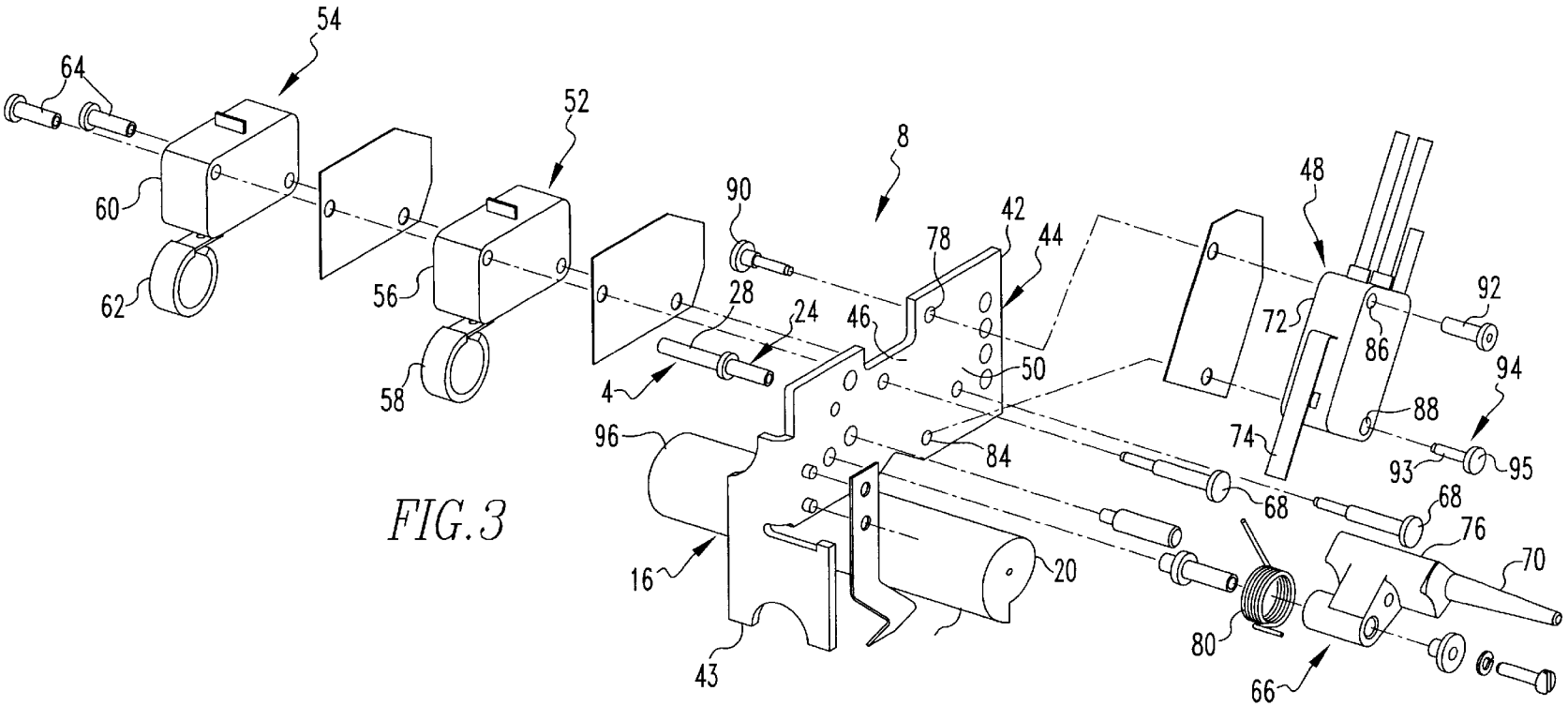
FIG. 3 is an exploded isometric view of a switch assembly incorporating the securing member.

As is best shown in FIG. 3, the plate 42 is formed with a first mounting hole 78 extending therethrough and a second mounting hole 84 extending therethrough. The alarm switch 48 is formed with a substantially cylindrical first bore 86 extending therethrough and a substantially cylindrical second bore 88 extending therethrough, the spacing of the first and second bores 86 and 88 being configured to correspond with the first and second mounting holes 78 and 84 formed in the plate 42.

The alarm switch 48 is mounted on the second side 50 of the plate 42 by a first pin 90 that is received in a plug 92 and a second pin 94 that is received in the opening 40 of the attachment structure 36 (FIGS. 1 and 2) of the fastener 24. The plug 92 is received in the first bore 86. The first pin 90 includes a flange and a shank, the flange being disposed against the first side 46, and the shank extending through the first mounting hole 78 and being received in a substantially cylindrical hole (not shown) formed in the plug 92. The shank of the first pin 90 is retained in the hole formed in the plug 92 by known structures and/or methods.

The attachment structure 36 (FIGS. 1 and 2) of the securing member 4 extends through the second mounting hole 84 and is received in the second bore 88 of the alarm switch 48. In such position, the flange 32 is disposed against the first side 46 of the plate 42, and the support post 28 extends in a direction generally away from the plate 42.

The second pin 94 includes an elongated shaft 93 and a head 95 extending radially outwardly from one end of the shaft 93. The shaft 93 is received in the opening 40 of the attachment structure 36 that has been received in the second bore 88, and the head 95 of the second pin 94 is disposed against the alarm switch housing 72. The shaft 93 of the second pin 94 is fixedly retained in the opening 40 by known attachment structures and/or methods.

When the switch assembly 8 is assembled as set forth above, the securing member 4 is disposed on the bracket 44 whereby the attachment structure 36 extends through the second mounting hole 84 and into the second bore 88 and cooperates with the second pin 94 to assist in mounting the alarm switch 48 on the plate 42. In such position, the shoulder formed by the flange 32 is disposed against the first side 46 of the plate 42, and the support post 28 extends outwardly and in a direction generally away from the first side 46.

Figure 4:
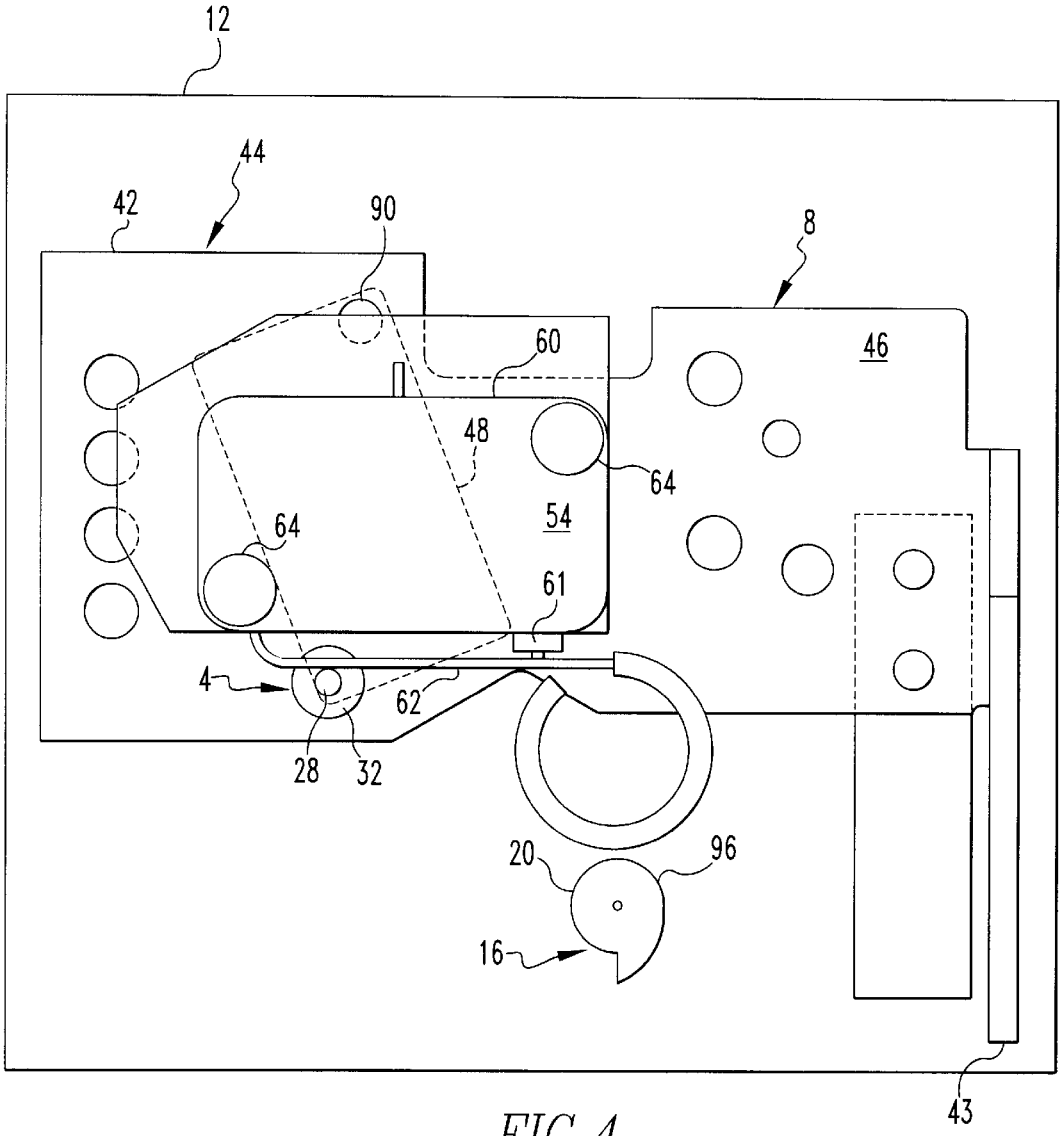
FIG. 4 is a left side view of the switch assembly shown in relation to a schematic representation of a circuit breaker.

As can be seen in FIG. 4, the support post 28 advantageously extends below the first and second actuation levers 58 and 62 of the first and second auxiliary switches 52 and 54. As can also be seen in FIG. 4, the looped ends of the first and second actuation levers 58 and 62 are disposed closely adjacent or against an upper surface 96 of the crossbar 20. As is understood in the relevant art, rotation of the crossbar 20 about an imaginary axis extending out of FIG. 4 results in the looped ends of the first and second actuation levers 58 and 62 sliding on the camming surface defined on the eccentric portion of the upper surface 96 of the crossbar 20. Such action has the result of compressing the first and second actuation levers 58 and 62 upwardly toward the first and second housing 56 and 60, respectively, and of operatively engaging the plungers of the first and second auxiliary switches 52 and 54 and operating the contacts thereof. As such, rotation of the crossbar 20 results in activation of any alarm bells, warning lights, or other indicator systems that are operatively connected with the first or second auxiliary switches 52 and 54.

When the circuit breaker 12 is returned to the latched condition and the crossbar 20 is returned to the orientation indicated generally in FIG. 4, the first and second actuation levers 58 and 62 similarly return to the position depicted in FIG. 4. As is understood in the relevant art, the first and second actuation levers 58 and 62 are biased to the position depicted generally in FIG. 4 by the natural elastic properties of the spring material out of which they are manufactured or by external biasing structures such as springs or other such structures. As is shown in FIG. 4, the first and second actuation levers 58 and 62 are in a first given position when the operating mechanism of the circuit breaker 12 is in the latched condition, whereby the first and second actuation levers 58 and 62 both rest against the arcuate outer surface of the support post 28, and the looped ends of the first and second actuation levers 58 and 62 rest against the upper surface 96 of the crossbar 20. It is understood that the rest positions of the first and second actuation levers 58 and 62, meaning the positions to which they are naturally biased, may nevertheless be at a point closer to the first and second housings 56 and 60, respectively, than the first given position, and that in such position the looped ends may be out of contact with the upper surface 96, without departing from the spirit of the present invention.

When the first and second actuation levers 58 and 62 are in the first given position disposed against the support post 28 of the securing member 4, the support post 28 retains the first and second actuation levers 58 and 62 in the first given position and advantageously resists any movement of the first and second actuation levers 58 and 62 to positions farther away from the first and second housings 56 and 60, respectively, then the first given position. In this regard, it can be seen that when the crossbar 20 (as depicted in FIG. 4) rapidly rotates in the counter-clockwise direction in conjunction with movement of the cradle of the operating mechanism 16 from the latched condition to the unlatched condition, the support post 28 resists movement of the first and second actuation levers 58 and 62 away from the first given position that might otherwise occur due to friction between the crossbar 20 and the looped ends of the first and second actuation levers 58 and 62. The support post 28 thus advantageously resists mis-actuation of the first and second actuation levers 58 and 62 that might otherwise interfere with proper functioning of the first and second auxiliary switches 52 and 54.

The configuration of the support post 28 advantageously resists movement of the first and second actuation lever 58 and 62 farther away from the first and second housings 56 and 60, respectively, than the first given position, yet permits the first and second actuation levers 58 and 62 to be moved closer to the first and second housings 56 and 60, respectively, than the first given position without obstruction. Moreover, inasmuch as the support post 28 is fixedly mounted on the fastener 24 that assists in mounting the alarm switch 48 on the bracket 44, the support post 28 does not require additional mounting structures for achieving the benefits therefrom.

The securing member 4 thus advantageously both resists movement of the first and second actuation levers 58 and 62 farther away from the first and second housing 56 and 60, respectively, than the first given position, and thus resists the first and second actuation levers 58 and 62 from becoming caught in the operating mechanism 16 that pivots the crossbar 20. The securing member 4 additionally assists in mounting the alarm switch 48 on the bracket 44. Such dual functionality of the securing member 4 is highly advantageous inasmuch as it is a cost-effective solution and requires only a very minimal amount of space within the crowded confines of the circuit breaker 12 and enhances the reliability of the switch assembly 8.

While a particular embodiment of the present invention has been described herein, it is understood that various changes, additions, modifications, and adaptations may be made without departing from the scope of the present invention, as set forth in the following claims.

We claim:

1. In an improved circuit breaker of the type including an operating mechanism and a switch assembly, the switch assembly including a bracket, a first switch, and a second switch, the second switch including a housing and an actuation lever, the actuation lever extending at least partially alongside and being movable with respect to the housing, the first switch being mounted on the bracket with a fastener, the improvement comprising:

a support post mounted on the fastener, the support post being disposed adjacent the actuation lever and being structured to resist movement of the actuation lever farther away from the housing than a given position.

2. The circuit breaker as set forth in claim 1, in which the second switch is mounted on the bracket.

3. The circuit breaker as set forth in claim 2, in which bracket includes a first side and a second side and is formed with at least a first mounting hole, and in which the fastener includes a shoulder, the fastener extending at least partially through the at least first mounting hole, the shoulder being disposed against the first side of the bracket, the first switch being mounted on the second side of the bracket, the second side being opposite the first side.

4. The circuit breaker as set forth in claim 3, in which the second switch is mounted on the first side of the bracket, and in which the support post extends from the shoulder in a direction generally away from the first switch.

5. The circuit breaker as set forth in claim 4, in which the circuit breaker further includes a third switch having a housing and an actuation lever, the actuation lever of the third switch extending at least partially alongside and being movable with respect to the housing thereof, the third switch being mounted to the first side of the bracket, the support post extending adjacent the actuation lever of the third switch and being structured to resist movement of the actuation lever of the third switch farther away from the housing of the third switch than a second given position.

6. The circuit breaker as set forth in claim 5, in which the actuation levers of the second and third switches are substantially aligned with one another.

7. The circuit breaker as set forth in claim 3, in which the shoulder is formed by a flange disposed on the fastener.

8. The circuit breaker as set forth in claim 4, in which the fastener is one of a plug and a pin.

9. The circuit breaker as set forth in claim 1, in which the actuation lever is abuttingly disposed against the support post when the actuation lever is in the given position.

10. The circuit breaker as set forth in claim 1, in which the operating mechanism includes a crossbar, and in which the support post is structured to resist movement of the actuation lever closer to the crossbar than the given position.

11. A method of resisting movement of a first actuation lever of a first switch farther away from a first housing of the first switch than a first given position, the method comprising the steps of:

mounting a second switch to a bracket with a fastener;

providing a support post extending from the fastener, the support post being disposed alongside the first actuation lever; and abutting the first actuation lever against the support post when the first actuation lever is in the first given position.

12. The method as set forth in claim 11, in which the step of providing a support post includes the step of configuring the support post to extend from the fastener in a direction generally away from the second switch.

13. The method as set forth in claim 11, in which the step of abutting the first actuation lever includes the step of resisting movement of the first actuation lever closer to a crossbar of an operating mechanism than the first given position.

14. The method as set forth in claim 11, in which the step of mounting a second switch includes the steps of at least partially receiving a portion of the fastener through a mounting hole formed in the bracket, disposing a flange of the fastener against a first side of the bracket, mounting the second switch on a second side of the bracket, and at least partially receiving a pin into a plug formed on the fastener.

* * * * *